US007879457B2

(12) United States Patent
Apte et al.

(10) Patent No.: US 7,879,457 B2
(45) Date of Patent: Feb. 1, 2011

(54) THERMAL SPRAY COATINGS AND APPLICATIONS THEREFOR

(75) Inventors: Prasad Shrikrishna Apte, East Amherst, NY (US); James Patrick Meagher, Buffalo, NY (US); Shawn W. Callahan, Tonawanda, NY (US)

(73) Assignee: Praxair S. T. Technology, Inc., North Haven, CT (US)

( * ) Notice: Subject to any disclaimer, the term of this patent is extended or adjusted under 35 U.S.C. 154(b) by 268 days.

(21) Appl. No.: 12/027,651

(22) Filed: Feb. 7, 2008

(65) Prior Publication Data

US 2008/0199722 A1 Aug. 21, 2008

Related U.S. Application Data

(60) Provisional application No. 60/901,963, filed on Feb. 16, 2007.

(51) Int. Cl.
*B32B 15/04* (2006.01)

(52) U.S. Cl. ..... 428/633; 428/678; 416/241 R

(58) Field of Classification Search ..... None
See application file for complete search history.

(56) References Cited

U.S. PATENT DOCUMENTS

| | | | | |
|---|---|---|---|---|
| 3,754,903 | A * | 8/1973 | Goward et al. | 420/443 |
| 4,913,961 | A | 4/1990 | Jones et al. | |
| 5,364,209 | A | 11/1994 | Santhanam et al. | |
| 5,455,119 | A | 10/1995 | Taylor et al. | |
| 5,741,556 | A | 4/1998 | Taylor et al. | |
| 6,136,453 | A | 10/2000 | Ritter et al. | |
| 6,521,293 | B1 | 2/2003 | Kojima et al. | |
| 6,638,575 | B1 | 10/2003 | Chen et al. | |
| 6,703,137 | B2 * | 3/2004 | Subramanian | 428/469 |
| 6,780,526 | B2 | 8/2004 | Payne et al. | |
| 2006/0172141 | A1 | 8/2006 | Huang et al. | |
| 2007/0207268 | A1 | 9/2007 | Webb et al. | |
| 2008/0032105 | A1 * | 2/2008 | Taylor | 428/215 |
| 2008/0199684 | A1 * | 8/2008 | Apte et al. | 428/328 |

FOREIGN PATENT DOCUMENTS

WO WO 2005/056872 A1 6/2005

OTHER PUBLICATIONS

Tucker, Robert C. Jr. "Thermal Spray Coatings". ASM Handbook, vol. 5, Surface Engineering (1994) pp. 497-509.

Superalloys II, eds. Sims, Stoloff and Hagel, John Wiley (1987), p. 387-458 (alloy making), p. 459-494 (powder making).

* cited by examiner

*Primary Examiner*—Aaron Austin
(74) *Attorney, Agent, or Firm*—Robert J. Hampsch

(57) ABSTRACT

This invention relates to coatings for a metal or non-metal substrate comprising (i) a thermal sprayed bondcoat layer applied to the substrate, and (ii) a thermal sprayed ceramic layer applied to the bondcoat layer; wherein said coating has a helium leak rate of less than $6\times10^{-6}$ standard cubic centimeters per second. The thermal sprayed bondcoat layer comprises an alloy of MCrAlM' wherein M is an element selected from nickel, cobalt, iron and mixtures thereof, and M' is an element selected from yttrium, zirconium, hafnium, ytterbium and mixtures thereof. The alloy is thermally sprayed from a powder having a mean particle size of 50 percentile point in distribution of from about 5 microns to about 100 microns. The coatings are useful for extending the service life under severe conditions, such as those associated with metallurgical vessels' lances, nozzles and tuyeres.

17 Claims, No Drawings

THERMAL SPRAY COATINGS AND APPLICATIONS THEREFOR

RELATED APPLICATIONS

This application claims the benefit of U.S. Provisional Application Ser. No. 60/901,963, filed on Feb. 6, 2007. This application is related to U.S. patent application Ser. No. 12/027,672, filed on an even date herewith; and incorporated herein by reference.

FIELD OF THE INVENTION

This invention relates to thermal spray coatings for use in harsh conditions, e.g., coatings that provide thermal insulation and corrosive barrier protection in harsh environments such as sulfuric acid recycling furnaces. In particular, it relates to coatings useful for extending the service life under severe conditions, such as those associated with metallurgical vessels' lances, nozzles and tuyeres.

BACKGROUND OF THE INVENTION

Tuyeres, often mounted on a bustle pipe inject air, oxygen and fuel into blast furnaces and smelters, such as Pierce-Smith converters. Similar to tuyeres, gas injection nozzles inject oxygen and fuel into electric arc furnaces' bath of molten steel. In addition, lance nozzles inject oxygen and fuel into basic oxygen furnaces used to manufacture steel. These lances, nozzles and tuyeres are usually water-cooled and made of high conductivity copper or copper-base alloys that have minimal resistance to molten slag or metal attack. In addition to these, metallurgical vessels' lances and nozzles typically experience both hot particle erosion and molten slag or metal attack.

An additional problem is the presence of corrosive gases. These corrosive gases include acids and non-acidic reactive metal vapors. The corrosive gases, such as chlorine and sulfur dioxide often originate from fuels or the oxidation of metal sulfides in the feed stock or melt. Similar to acidic gases, reactive vapors such as, cadmium, lead, zinc, etc. typically originate from their inclusion in scrap steel feed to blast and electric arc furnaces. These gases aggressively attack metal injection devices. For example, sulfur dioxide readily reacts with copper and forms sulfides such as, copper sulfide (CuS).

Yet another problem with coated tuyeres and nozzle tips is cracking after a period of service under extreme cyclic heating and cooling. This cracking can propagate toward the inner wall, causing eventual water leakage.

Thermal barrier coatings are used in high temperature environments. The thermal barrier coating is considered a system, comprised of the superalloy substrate alloy, a metallic bondcoat and a zirconia-based outer ceramic layer. The zirconia ceramic has relatively low thermal conductivity and thus provides thermal insulation to the substrate. It would be desirable in the art to provide thermal barrier coatings that provide not only thermal insulation but also corrosive barrier protection in harsh environments such as sulfuric acid recycling furnaces.

SUMMARY OF THE INVENTION

This invention relates to a coating for a metal or non-metal substrate comprising a thermally sprayed ceramic coating applied to said metal or non-metal substrate, wherein said coating has a helium leak rate of less than $6\times10^{-6}$ standard cubic centimeters per second.

This invention also relates to a method for protecting a metal or non-metal substrate, said method comprising applying a thermally sprayed ceramic coating to said metal or non-metal substrate, wherein said ceramic coating has a helium leak rate of less than $6\times10^{-6}$ standard cubic centimeters per second.

This invention further relates to a coating for a metal or non-metal substrate comprising (i) a thermal sprayed bondcoat layer applied to said substrate comprising an alloy of MCrAlM' wherein M is an element selected from nickel, cobalt, iron and mixtures thereof, and M' is an element selected from yttrium, zirconium, hafnium, ytterbium and mixtures thereof, and wherein M comprises from about 35 to about 80 weight percent of said alloy, Cr comprises from about 15 to about 45 weight percent of said alloy, Al comprises from about 5 to about 30 weight percent of said alloy, and M' comprises from about 0.01 to about 1.0 weight percent of said alloy, said alloy thermally sprayed from a powder having a mean particle size of 50 percentile point in distribution of from about 5 microns to about 100 microns, said bondcoat having a surface roughness of at least 200 microinches, and said bondcoat having a thermal expansion of about 6.5 millimeters per meter or less between a temperature of from about 25° C. to about 525° C., and (ii) a thermal sprayed ceramic layer applied to said bondcoat layer; wherein said coating has a helium leak rate of less than $6\times10^{-6}$ standard cubic centimeters per second.

This invention yet further relates to a method for protecting, e.g., minimizing or eliminating corrosion, a metal or non-metal substrate, said method comprising (i) applying a thermal sprayed bondcoat layer to said metal or non-metal substrate, said bondcoat layer comprising an alloy of MCrAlM' wherein M is an element selected from nickel, cobalt, iron and mixtures thereof, and M' is an element selected from yttrium, zirconium, hafnium, ytterbium and mixtures thereof, and wherein M comprises from about 35 to about 80 weight percent of said alloy, Cr comprises from about 15 to about 45 weight percent of said alloy, Al comprises from about 5 to about 30 weight percent of said alloy, and M' comprises from about 0.01 to about 1.0 weight percent of said alloy, said alloy thermally sprayed from a powder having a mean particle size of 50 percentile point in distribution of from about 5 microns to about 100 microns, said bondcoat having a surface roughness of at least 200 microinches, and wherein said bondcoat layer has a thermal expansion of about 6.5 millimeters per meter or less between a temperature of from about 25° C. to about 525° C., and (ii) applying a thermal sprayed ceramic layer to said bondcoat layer; wherein said bondcoat layer and said ceramic layer have a helium leak rate of less than $6\times10^{-6}$ standard cubic centimeters per second.

Optionally, a third layer of boride or carbide coating may be applied over the ceramic for additional erosion resistance. Advantageously, the device coated is an injection device for a metallurgical vessel such as a lance, nozzle or tuyere. This coating is useful for devices constructed of various metals such as cobalt-base alloys, copper, copper-base alloys, nickel-base alloys and stainless steels. Most advantageously, this coating is applied to copper or copper-base alloys.

The invention has several advantages. For example, the low thermal expansion of the bondcoats of this invention minimizes or eliminates interface stress and crack formation in the ceramic layer and therefore leads to longer thermal barrier coating cycle life. There are many applications where a cast or wrought alloy having lower thermal expansion would allow an article to have superior performance. Articles fabricated from the alloy powders of this invention, e.g., cast or wrought alloy articles, may exhibit good high temperature oxidation resistance, even better than typical Ni-based superalloys or stainless steels, due to the high Cr and Al content of the alloy powders of this invention.

DETAILED DESCRIPTION OF THE INVENTION

Alloy powders suitable for use in this invention can be coarse or fine and comprise an alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said alloy, Cr comprises from about 15 to about 45 weight percent of said alloy, Al comprises from about 5 to about 30 weight percent of said alloy, and M' comprises from about 0.01 to about 1.0 weight percent of said alloy, said alloy powder having a mean particle size of 50 percentile point in distribution of from about 5 microns to about 100 microns. In an embodiment, the coarse alloy powder of this invention has a mean particle size of 50 percentile point in distribution of from about 30 microns to about 100 microns. In another embodiment, the fine alloy powder of this invention has a mean particle size of 50 percentile point in distribution of from about 5 microns to about 50 microns.

Preferred alloy powders include those where M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. The coarse alloy powders preferably have a mean particle size of 50 percentile point in distribution of from about 40 microns to about 85 microns, more preferably a mean particle size of 50 percentile point in distribution of from about 50 microns to about 60 microns. The fine alloy powders preferably have a mean particle size of 50 percentile point in distribution of from about 10 microns to about 40 microns, more preferably a mean particle size of 50 percentile point in distribution of from about 18 microns to about 25 microns.

An alpha-Cr phase is present in the alloys up to a temperature of at least about 1000° C. Preferably, the alpha-Cr phase is present in an amount sufficient to control thermal expansion of the alloys to about 6.5 mm/m or less between a temperature of from about 25° C. to about 525° C. The alloys may be heat treated to stabilize their equilibrium phases. An alpha-Cr phase is preferably in equilibrium in a thermally stabilized coating comprising the alloys at a temperature of about 800° C. and the alpha-Cr phase does not dissolve upon heating to a temperature of at least about 1000° C. The alloys fall within the gamma-beta-alpha-Cr region of a phase diagram, for example, an alpha-Cr+beta-NiAl+gamma (FCC Ni alloy) phase field, at a temperature of about 1150° C.

The alloys may be prepared by conventional methods such as described in Superalloys II, eds. Sims, Stoloff and Hagel, John Wiley (1987), p. 387-458 . The alloy powders useful in this invention may be prepared by conventional methods such as described in U.S. Pat. Nos. 5,455,119 and 5,741,556, the disclosures of which are incorporated herein by reference.

Articles can be produced from the alloys above, e.g., cast or wrought alloy articles, and coatings made from the powders. The powders suitable for thermal spraying or other cladding methods made from the alloys above may include up to about 10 volume percent stable oxide particles. e.g., yttria, hafnia or alumina. For certain coatings made from the powders above, during deposition of the coating, oxygen and/or carbon are intentionally added to the coating.

Coating compositions suitable for use in this invention comprise an alloy powder of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said alloy, Cr comprises from about 15 to about 45 weight percent of said alloy, Al comprises from about 5 to about 30 weight percent of said alloy, and M' comprises from about 0.01 to about 1.0 weight percent of said alloy, said alloy powder having a mean particle size of 50 percentile point in distribution of from about 5 microns to about 100 microns. The coarse alloy powders have a mean particle size of 50 percentile point in distribution of from about 30 microns to about 100 microns, and the fine alloy powders have a mean particle size of 50 percentile point in distribution of from about 5 microns to about 50 microns.

Preferred coating compositions include alloy powders where M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. The coarse alloy powders preferably have a mean particle size of 50 percentile point in distribution of from about 40 microns to about 85 microns, and more preferably a mean particle size of 50 percentile point in distribution of from about 50 microns to about 60 microns. The fine alloy powders preferably have a mean particle size of 50 percentile point in distribution of from about 10 microns to about 40 microns, and more preferably a mean particle size of 50 percentile point in distribution of from about 18 microns to about 25 microns.

An alpha-Cr phase is present in the alloys up to a temperature of at least about 1000° C. Preferably, the alpha-Cr phase is present in an amount sufficient to control thermal expansion of the alloys to about 6.5 mm/m or less between a temperature of from about 25° C. to about 525° C. The alloys may be heat treated to stabilize their equilibrium phases. An alpha-Cr phase is preferably in equilibrium in a thermally stabilized coating comprising the alloys at a temperature of about 800° C. and the alpha-Cr phase does not dissolve upon heating to a temperature of at least about 1000° C. The alloys fall within the gamma-beta-alpha-Cr region of a phase diagram, for example, an alpha-Cr+beta-NiAl+gamma (FCC Ni alloy) phase field, at a temperature of about 1150° C.

An oxide dispersion may also be included in the coating compositions. The oxide dispersion may be selected from alumina, thoria, yttria and rare earth oxides, hafnia and zirconia. The oxide dispersion may comprise from about 5 to about 25 volume percent of the coating composition.

The coating compositions useful in this invention may be prepared by conventional methods such as described in Superalloys II, p. 459-494 (powder making) and ASM Handbook, Vol. 5 , Surface Engineering 1994, p. 497-509 (thermal spray coatings).

Articles can be produced from the coating compositions above and coatings can be made from the powders. The powders suitable for thermal spraying or other cladding methods made from the alloys above may include up to about 10 volume percent stable oxide particles. e.g., yttria, hafnia or alumina. For certain coatings made from the powders above, during deposition of the coating, oxygen and/or carbon are intentionally added to the coating.

The thermal, e.g., plasma, sprayed bondcoats used in the coatings can comprise an alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said alloy, Cr comprises from about 15 to about 45 weight percent of said alloy, Al comprises from about 5 to about 30 weight percent of said alloy, and M' comprises from about 0.01 to about 1.0 weight percent of said alloy, said alloy thermally sprayed from a powder having a mean particle size of 50 percentile point in distribution of from about 5 microns to about 100 microns, said bondcoat having a surface roughness of at least 200 micro-inches, and said bondcoat having a thermal expansion of about 6.5 millimeters per meter or less between a temperature of from about 25° C. to about 525° C.; wherein said bondcoat has a helium leak rate of less than $6\times10^{-6}$ standard cubic centimeters per second.

Preferred thermal, e.g., plasma, sprayed bondcoats include those wherein, in the composition of the alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. In one embodiment, the alloy is sprayed from a coarse powder having a mean particle size of 50 percentile point in distribution of from about 30 microns to about 100 microns, preferably a mean particle size of 50 percentile point in distribution of from about 40 microns to about 85 microns, and more preferably a mean particle size of 50 percentile point in distribution of from about 50 microns to about 60 microns. In another embodiment, the alloy is sprayed from a fine powder having a mean particle size of 50 percentile point in distribution of from about 5 microns to about 50 microns, preferably a mean particle size of 50 percentile point in distribution of from about 10 microns to about 40 microns, and more preferably a mean particle size of 50 percentile point in distribution of from about 18 microns to about 25 microns.

The bondcoats preferably have a surface roughness of at least 225 micro-inches, more preferably a surface roughness of at least 250 micro-inches. The bondcoats preferably have a thermal expansion of about 6.25 millimeters per meter or less between a temperature of from about 25° C. to about 525° C., more preferably a thermal expansion of about 6.0 millimeters per meter or less between a temperature of from about 25° C. to about 525° C. The bondcoats typically have a thickness of from about 4 to about 480 mils, preferably a thickness of from about 80 to about 400 mils.

A key measure of a coating's ability to seal is determined by a helium leak rate. A coating which has a helium leak rate of less than $6\times10^{-6}$ atm-cc/sec (standard cubic centimeters per second) is highly desirable, less than $4\times10^{-6}$ atm-cc/sec (standard cubic centimeters per second) is preferred, and less than $2\times10^{-6}$ atm-cc/sec (standard cubic centimeters per second) is more preferred. As set forth herein, the plasma spray methodology and coating composition are important to a successful coatings. The plasma spray deposition is preferably sufficient to give a helium leak rate of less than $2.0\times10^{-6}$ standard cubic centimeters per second.

An alpha-Cr phase is present in the bondcoats up to a temperature of at least about 1000° C. Preferably, the alpha-Cr phase is present in an amount sufficient to control thermal expansion of the bondcoats to about 6.5 mm/m or less between a temperature of from about 25° C. to about 525° C. The bondcoats may be heat treated to stabilize their equilibrium phases. An alpha-Cr phase is preferably in equilibrium in thermally stabilized bondcoats at a temperature of about 800° C. and the alpha-Cr phase does not dissolve upon heating to a temperature of at least about 1000° C. The bondcoats fall within the gamma-beta-alpha-Cr region of a phase diagram, for example, an alpha-Cr+beta-NiAl+gamma (FCC Ni alloy) phase field, at a temperature of about 1150° C.

An oxide dispersion may also be included in the bondcoats. The oxide dispersion may be selected from alumina, thoria, yttria and rare earth oxides, hafnia and zirconia. The oxide dispersion may comprise from about 5 to about 25 volume percent of the bondcoat. Articles can be produced from the bondcoats above.

The bondcoats can be deposited onto a metal or non-metal substrate using any thermal spray device by conventional methods. Preferred thermal spray methods for depositing the bondcoat are plasma spraying including inert gas shrouded plasma spraying and low pressure or vacuum plasma spraying in chambers. Other deposition methods that may be useful in this invention include high velocity oxygen-fuel torch spraying, detonation gun coating and the like. The most preferred method is inert gas shrouded plasma spraying and low pressure or vacuum plasma spraying in chambers. It could also be advantageous to heat treat the bondcoat using appropriate times and temperatures to achieve a good bond for the bondcoat to the substrate and a high sintered density of the bondcoat. Other means of applying a uniform deposit of powder to a substrate in addition to thermal spraying include, for example, electrophoresis, electroplating and slurry deposition.

The method of this invention preferably employs plasma spray methodology. The plasma spraying is suitably carried out using fine agglomerated powder particle sizes, typically having an average agglomerated particle size of less than about 50 microns, preferably less than about 40 microns, and more preferably from about 5 to about 50 microns. Individual particles useful in preparing the agglomerates typically range in size from nanocrystalline size to about 5 microns in size. The plasma medium can be argon, helium or a combination thereof.

The thermal content of the plasma gas stream can be varied by changing the electrical power level, gas flow rates, or gas composition. Argon is usually the base gas, but helium, hydrogen and nitrogen are frequently added. The velocity of the plasma gas stream can also be varied by changing the same parameters.

Variations in gas stream velocity from the plasma spray device can result in variations in particle velocities and hence dwell time of the particle in flight. This affects the time the particle can be heated and accelerated and, hence, its maximum temperature and velocity. Dwell time is also affected by the distance the particle travels between the torch or gun and the surface to be coated.

The specific deposition parameters depend on both the characteristics of the plasma spray device and the materials being deposited. The rate of change or the length of time the parameters are held constant are a function of both the required coating composition, the rate of traverse of the gun or torch relative to the surface being coated, and the size of the part. Thus, a relatively slow rate of change when coating a large part may be the equivalent of a relatively large rate of change when coating a small part.

The bondcoat may comprise two metallic layers, both of the same or different low expansion alloy composition. An inner layer bondcoat may be made using fine powder for the thermal spray that is dense and protective to the substrate from oxidation. An outer layer bondcoat may be made from coarser powder to provide a rougher surface for the subsequent attachment of the ceramic layer.

The thermal, e.g., plasma, sprayed bondcoats useful in the coatings can comprise (i) a thermal, e.g., plasma, sprayed inner layer comprising an inner layer alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said inner layer alloy, Cr comprises from about 15 to about 45 weight percent of said inner layer alloy, Al comprises from about 5 to about 30 weight percent of said inner layer alloy, and M' comprises from about 0.01 to about 1.0 weight percent of said inner layer alloy, said inner layer alloy thermally sprayed from a powder having a mean particle size of 50 percentile point in distribution of from about 5 microns to about 50 microns; and (ii) a thermal, e.g., plasma, sprayed outer layer comprising an outer layer alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said outer layer alloy, Cr comprises from about 15 to about 45 weight percent of said outer layer alloy, Al comprises from about 5 to about 30 weight percent of said outer layer alloy, and M' comprises from about 0.01 to about 1.0 weight percent of said outer layer alloy, said outer layer alloy thermally sprayed from a powder having a mean particle size of 50 percentile point in distribution of from about 30 microns to about 100 microns, and said outer layer having a surface roughness of at least 200 micro-inches; and wherein said bondcoat has a thermal expansion of about 6.5 millimeters per meter or less between a temperature of from about 25° C. to about 525° C.; wherein said bondcoats have a helium leak rate of less than $6\times10^{-6}$ standard cubic centimeters per second. The inner layer alloy and the outer layer alloy may be of the same or different composition.

The multilayer bondcoats described above is an embodiment of U.S. patent application Ser. No. (21695-R2), filed on an even date herewith and incorporated by reference herein.

Preferred thermal, e.g., plasma, sprayed inner layer bondcoats include those wherein, in the composition of the inner layer alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. The alloy is preferably sprayed from a powder having a mean particle size of 50 percentile point in distribution of from about 10 microns to about 40 microns, more preferably a mean particle size of 50 percentile point in distribution of from about 18 microns to about 25 microns.

Preferred thermal, e.g., plasma, sprayed outer layer bondcoats include those wherein, in the composition of the outer layer alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. The alloy is preferably sprayed from a powder having a mean particle size of 50 percentile point in distribution of from about 40 microns to about 85 microns, more preferably a mean particle size of 50 percentile point in distribution of from about 50 microns to about 60 microns.

The outer layer bondcoats preferably have a surface roughness of at least 225 micro-inches, more preferably a surface roughness of at least 250 micro-inches. The bondcoats preferably have a thermal expansion of about 6.25 millimeters per meter or less between a temperature of from about 25° C. to about 525° C., more preferably a thermal expansion of about 6.0 millimeters per meter or less between a temperature of from about 25° C. to about 525° C.

The inner layer bondcoats typically have a thickness of from about 4 to about 320 mils, preferably a thickness of from about 40 to about 240 mils, and more preferably a thickness of from about 80 to about 160 mils. The outer layer bondcoats typically have a thickness of from about 4 to about 480 mils, preferably a thickness of from about 80 to about 400 mils, and more preferably a thickness of from about 160 to about 240 mils.

A key measure of a coating's ability to seal is determined by a helium leak rate. A coating which has a helium leak rate of less than $6\times10^{-6}$ atm-cc/sec (standard cubic centimeters per second) is highly desirable, less than $4\times10^{-6}$ atm-cc/sec (standard cubic centimeters per second) is preferred, and less than $2\times10^{-6}$ atm-cc/sec (standard cubic centimeters per second) is more preferred. As set forth herein, the plasma spray methodology and coating composition are important to a successful coating. The plasma spray deposition is preferably sufficient to give a helium leak rate of less than $2.0\times10^{-6}$ standard cubic centimeters per second.

An alpha-Cr phase is present in the bondcoats up to a temperature of at least about 1000° C. Preferably, the alpha-Cr phase is present in an amount sufficient to control thermal expansion of the bondcoats to about 6.5 mm/m or less between a temperature of from about 25° C. to about 525° C. The bondcoats may be heat treated to stabilize their equilibrium phases. An alpha-Cr phase is preferably in equilibrium in thermally stabilized bondcoats at a temperature of about 800° C and the alpha-Cr phase does not dissolve upon heating to a temperature of at least about 1000° C. The bondcoats fall within the gamma-beta-alpha-Cr region of a phase diagram, for example, an alpha-Cr+beta-NiAl+gamma (FCC Ni alloy) phase field, at a temperature of about 1150° C.

An oxide dispersion may also be included in the bondcoats. The oxide dispersion may be selected from alumina, thoria, yttria and rare earth oxides, hafnia and zirconia. The oxide dispersion may comprise from about 5 to about 25 volume percent of the bondcoat composition. Articles can be produced from the bondcoats above.

The inner layer bondcoats can be deposited onto a metal or non-metal substrate and the outer layer bondcoats can be deposited onto the inner layer bondcoats using any thermal spray device by conventional methods. Preferred thermal spray methods for depositing the bondcoats are plasma spraying including inert gas shrouded plasma spraying and low pressure or vacuum plasma spraying in chambers. Other deposition methods that may be useful in this invention include high velocity oxygen-fuel torch spraying, detonation gun coating and the like. The most preferred method is inert gas shrouded plasma spraying and low pressure or vacuum plasma spraying in chambers. It could also be advantageous to heat treat the bondcoats using appropriate times and temperatures to achieve a good bond for the bondcoats to the substrate and a high sintered density of the bondcoats. Other means of applying a uniform deposit of powder to a substrate in addition to thermal spraying include, for example, electrophoresis, electroplating and slurry deposition.

The method of this invention preferably employs plasma spray methodology. The plasma spraying is suitably carried out using fine agglomerated powder particle sizes, typically having an average agglomerated particle size of less than about 50 microns, preferably less than about 40 microns, and more preferably from about 5 to about 50 microns. Individual particles useful in preparing the agglomerates typically range in size from nanocrystalline size to about 5 microns in size. The plasma medium can be argon, helium or a combination thereof.

The thermal content of the plasma gas stream can be varied by changing the electrical power level, gas flow rates, or gas composition. Argon is usually the base gas, but helium, hydrogen and nitrogen are frequently added. The velocity of the plasma gas stream can also be varied by changing the same parameters.

Variations in gas stream velocity from the plasma spray device can result in variations in particle velocities and hence dwell time of the particle in flight. This affects the time the particle can be heated and accelerated and, hence, its maximum temperature and velocity. Dwell time is also affected by the distance the particle travels between the torch or gun and the surface to be coated.

The specific deposition parameters depend on both the characteristics of the plasma spray device and the materials being deposited. The rate of change or the length of time the parameters are held constant are a function of both the required coating composition, the rate of traverse of the gun or torch relative to the surface being coated, and the size of the part. Thus, a relatively slow rate of change when coating a large part may be the equivalent of a relatively large rate of change when coating a small part.

As indicated above, this invention relates to a coating for a metal or non-metal substrate comprising a thermally sprayed ceramic coating applied to said metal or non-metal substrate, wherein said coating has a helium leak rate of less than $6\times10^{-6}$ standard cubic centimeters per second.

Illustrative ceramic coatings comprise zirconium oxide and yttrium oxide. Preferred ceramic coatings include zirconia partially or fully stabilized by yttria and having a density greater than 88% of the theoretical density. Other ceramic coatings useful in this invention include zirconia partially or fully stabilized by yttria and having a density from about 60% to 85% of the theoretical density, e.g., low density zirconia partially or fully stabilized by yttria. The ceramic coatings typically have a thickness of from about 0.001 to about 0.1 inches, preferably from about 0.005 to about 0.05 inches.

Advantageously, the zirconia-based coating is selected from the group consisting of zirconia, partially stabilized zirconia and fully stabilized zirconia. Most advantageously, this coating is a partially stabilized zirconia, such as calcia, ceria or other rare earth oxides, magnesia and yttria-stabilized zirconia. The most preferred stabilizer is yttria. In particular, the partially stabilized zirconia $ZrO_2$-$8Y_2O_3$ provides excellent resistant to heat and corrosion.

The zirconia-based ceramic coating advantageously is thermally insulating and has a density of at least about eighty percent to limit the corrosive effects of hot acidic gases upon the substrate. Most advantageously, this density is at least about ninety percent.

An optional top layer that can cover the ceramic coating is a heat and hot erosion resistant carbide or boride coating. The coating material may be any heat resistant chromium boride or carbide such as, CrB, $Cr_3C_2$, $Cr_7C_3$ or $Cr_{23}C_6$. The coating may be a pure carbide/boride or in a heat resistant alloy matrix of cobalt or nickel-base superalloy.

A key measure of a coating's ability to seal is determined by a helium leak rate. A coating which has a helium leak rate of less than $6\times10^{-6}$ atm-cc/sec (standard cubic centimeters per second) is highly desirable, less than $4\times10^{-6}$ atm-cc/sec (standard cubic centimeters per second) is preferred, and less than $2\times10^{-6}$ atm-cc/sec (standard cubic centimeters per second) is more preferred. As set forth herein, the plasma spray methodology and coating composition are important to a successful leak tight coating. The plasma spray deposition is preferably sufficient to give a helium leak rate of less than $2.0\times10^{-6}$ standard cubic centimeters per second.

The ceramic coating can be deposited onto a metal or non-metal substrate using any thermal spray device by conventional methods. Preferred thermal spray methods for depositing the ceramic coatings are plasma spraying including inert gas shrouded plasma spraying and low pressure or vacuum plasma spraying in chambers. Other deposition methods that may be useful in this invention include high velocity oxygen-fuel torch spraying, detonation gun coating and the like. The most preferred method is inert gas shrouded plasma spraying and low pressure or vacuum plasma spraying in chambers. It could also be advantageous to heat treat the ceramic coating using appropriate times and temperatures to achieve a good bond for the ceramic coating to the substrate and a high sintered density of the ceramic coating. Other means of applying a uniform deposit of powder to a substrate in addition to thermal spraying include, for example, electrophoresis, electroplating and slurry deposition.

The method of this invention preferably employs plasma spray methodology. The plasma spraying is suitably carried out using fine agglomerated powder particle sizes, typically having an average agglomerated particle size of less than about 50 microns, preferably less than about 40 microns, and more preferably from about 5 to about 50 microns. Individual particles useful in preparing the agglomerates typically range in size from nanocrystalline size to about 5 microns in size. The plasma medium can be argon, helium or a combination thereof.

The thermal content of the plasma gas stream can be varied by changing the electrical power level, gas flow rates, or gas composition. Argon is usually the base gas, but helium, hydrogen and nitrogen are frequently added. The velocity of the plasma gas stream can also be varied by changing the same parameters.

Variations in gas stream velocity from the plasma spray device can result in variations in particle velocities and hence dwell time of the particle in flight. This affects the time the particle can be heated and accelerated and, hence, its maximum temperature and velocity. Dwell time is also affected by the distance the particle travels between the torch or gun and the surface to be coated.

The specific deposition parameters depend on both the characteristics of the thermal, e.g., plasma, spray device and the materials being deposited. The rate of change or the length of time the parameters are held constant are a function of both the required coating composition, the rate of traverse of the gun or torch relative to the surface being coated, and the size of the part. Thus, a relatively slow rate of change when coating a large part may be the equivalent of a relatively large rate of change when coating a small part.

As indicated above, this invention also relates to thermal, e.g., plasma, sprayed coatings for a metal or non-metal substrate comprising (i) a thermal, e.g., plasma, sprayed bond-coat layer applied to said substrate comprising an alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said alloy, Cr comprises from about 15 to about 45 weight percent of said alloy, Al comprises from about 5 to about 30 weight percent of said alloy, and M' comprises from about 0.01 to about 1.0 weight percent of said alloy, said alloy thermally sprayed from a powder having a mean particle size of 50 percentile point in distribution of from about 5 microns to about 100 microns, said bondcoat having a surface roughness of at least 200 micro-inches, and said bondcoat having a thermal expansion of about 6.5 millimeters per meter or less between a temperature of from about 25° C. to about 525° C., and (ii) a thermal, e.g., plasma, sprayed ceramic layer applied to said bondcoat layer; wherein said coating has a helium leak rate of less than $6\times10^{-6}$ standard cubic centimeters per second.

Preferred bondcoat layers of this invention include those wherein, in the composition of the alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. In one embodiment, the alloy is sprayed from a coarse powder having a mean particle size of 50 percentile point in distribution of from about 30 microns to about 100 microns, preferably a mean particle size of 50 percentile point in distribution of from about 40 microns to about 85 microns, and more preferably a mean particle size of 50 percentile point in distribution of from about 50 microns to about 60 microns. In another embodiment, the alloy is sprayed from a fine powder having a mean particle size of 50 percentile point in distribution of from about 5 microns to about 50 microns, preferably a mean particle size of 50 percentile point in distribution of from about 10 microns to about 40 microns, and more preferably a mean particle size of 50 percentile point in distribution of from about 18 microns to about 25 microns.

The bondcoat layers of this invention preferably have a surface roughness of at least 225 micro-inches, more preferably a surface roughness of at least 250 micro-inches. The bondcoat layers preferably have a thermal expansion of about 6.25 millimeters per meter or less between a temperature of from about 25° C. to about 525° C. more preferably a thermal expansion of about 6.0 millimeters per meter or less between a temperature of from about 25° C. to about 525° C. The bondcoat layers typically have a thickness of from about 4 to about 480 mils, preferably a thickness of from about 80 to about 400 mils, and more preferably a thickness of from about 160 to about 240 mils.

A key measure of a coating's ability to seal is determined by a helium leak rate. A coating which has a helium leak rate of less than $6\times10^{-6}$ atm-cc/sec (standard cubic centimeters per second) is highly desirable, less than $4\times10^{-6}$ atm-cc/sec (standard cubic centimeters per second) is preferred, and less than $2\times10^{-6}$ atm-cc/sec (standard cubic centimeters per second) is more preferred. As set forth herein, the plasma spray methodology and coating composition are important to a successful coating. The plasma spray deposition is preferably sufficient to give a helium leak rate of less than $2.0\times10^{-6}$ standard cubic centimeters per second.

An alpha-Cr phase is present in the bondcoat layers of this invention up to a temperature of at least about 1000° C. Preferably, the alpha-Cr phase is present in an amount sufficient to control thermal expansion of the bondcoat layer to about 6.5 mm/m or less between a temperature of from about 25° C. to about 525° C. The bondcoat layers of this invention may be heat treated to stabilize their equilibrium phases. An alpha-Cr phase is preferably in equilibrium in thermally stabilized bondcoat layer of this invention at a temperature of about 800° C. and the alpha-Cr phase does not dissolve upon heating to a temperature of at least about 1000° C. The bondcoat layers of this invention fall within the gamma-beta-alpha-Cr region of a phase diagram, for example, an alpha-Cr+beta-NiAl+gamma (FCC Ni alloy) phase field, at a temperature of about 1150° C.

An oxide dispersion may also be included in the bondcoat layers of this invention. The oxide dispersion may be selected from alumina, thoria, yttria and rare earth oxides, hafnia and zirconia. The oxide dispersion may comprise from about 5 to about 25 volume percent of the bondcoat layer. This invention also relates to articles produced from the barrier coatings above.

Illustrative ceramic layers comprise zirconium oxide and yttrium oxide. Preferred ceramic layers include zirconia partially or fully stabilized by yttria and having a density greater than 88% of the theoretical density. Other ceramic layers useful in this invention include zirconia partially or fully stabilized by yttria and having a density from about 60% to 85% of the theoretical density, e.g., low density zirconia partially or fully stabilized by yttria. The ceramic layer typically has a thickness of from about 0.001 to about 0.1 inches, preferably from about 0.005 to about 0.05 inches.

Advantageously, the zirconia-based layer is selected from the group consisting of zirconia, partially stabilized zirconia and fully stabilized zirconia. Most advantageously, this layer is a partially stabilized zirconia, such as calcia, ceria or other rare earth oxides, magnesia and yttria-stabilized zirconia. The most preferred stabilizer is yttria. In particular, the partially stabilized zirconia $ZrO_2$-$8Y_2O_3$ provides excellent resistant to heat and corrosion.

The zirconia-based ceramic layer advantageously is thermally insulating and has a density of at least about eighty percent to limit the corrosive effects of hot acidic gases upon the under layer. Most advantageously, this density is at least about ninety percent.

The optional top layer that covers the ceramic is a heat and hot erosion resistant carbide or boride coating. The coating material may be any heat resistant chromium boride or carbide such as, CrB, $Cr_3C_2$, $Cr_7C_3$ or $Cr_{23}C_6$. The coating may be a pure carbide/boride or in a heat resistant alloy matrix of cobalt or nickel-base superalloy.

Some suitable metal substrates include, for example, nickel base superalloys, nickel base superalloys containing titanium, cobalt base superalloys, and cobalt base superalloys containing titanium. Preferably, the nickel base superalloys would contain more than 50% by weight nickel and the cobalt base superalloys would contain more than 50% by weight cobalt. Illustrative non-metal substrates include, for example, permissible silicon-containing materials.

The bondcoat layer can be deposited onto a metal or non-metal substrate, and the ceramic layer can be deposited onto the bondcoat layer, using any thermal spray device by conventional methods. Preferred thermal spray methods for depositing the bondcoat layer and ceramic layer are plasma spraying including inert gas shrouded plasma spraying and low pressure or vacuum plasma spraying in chambers. Other deposition methods that may be useful in this invention include high velocity oxygen-fuel torch spraying, detonation gun coating and the like. The most preferred method is inert gas shrouded plasma spraying and low pressure or vacuum plasma spraying in chambers. It could also be advantageous to heat treat the bondcoat using appropriate times and temperatures to achieve a good bond for the bondcoat to the substrate and a high sintered density of the bondcoat. Other means of applying a uniform deposit of powder to a substrate in addition to thermal spraying include, for example, electrophoresis, electroplating and slurry deposition.

The method of this invention preferably employs plasma spray methodology. The plasma spraying is suitably carried out using fine agglomerated powder particle sizes, typically having an average agglomerated particle size of less than about 50 microns, preferably less than about 40 microns, and more preferably from about 5 to about 50 microns. Individual particles useful in preparing the agglomerates typically range in size from nanocrystalline size to about 5 microns in size. The plasma medium can be argon, helium or a combination thereof.

The thermal content of the plasma gas stream can be varied by changing the electrical power level, gas flow rates, or gas composition. Argon is usually the base gas, but helium, hydrogen and nitrogen are frequently added. The velocity of the plasma gas stream can also be varied by changing the same parameters.

Variations in gas stream velocity from the plasma spray device can result in variations in particle velocities and hence dwell time of the particle in flight. This affects the time the particle can be heated and accelerated and, hence, its maximum temperature and velocity. Dwell time is also affected by the distance the particle travels between the torch or gun and the surface to be coated.

The specific deposition parameters depend on both the characteristics of the plasma spray device and the materials being deposited. The rate of change or the length of time the parameters are held constant are a function of both the required coating composition, the rate of traverse of the gun or torch relative to the surface being coated, and the size of the part. Thus, a relatively slow rate of change when coating a large part may be the equivalent of a relatively large rate of change when coating a small part.

In an embodiment, the bondcoat layer may comprise two metallic layers, both of the same or different low expansion alloy composition. An inner layer bondcoat may be made using fine powder for the thermal spray that is dense and protective to the substrate from oxidation. An outer layer bondcoat may be made from coarser powder to provide a rougher surface for the subsequent attachment of the ceramic layer.

Referring to this embodiment, this invention also relates to thermal, e.g., plasma, sprayed coatings for a metal or non-metal substrate comprising (a) a thermal, e.g., plasma, sprayed bondcoat layer applied to said substrate, said bondcoat layer comprising: (i) a thermal, e.g., plasma, sprayed inner layer comprising an inner layer alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said inner layer alloy, Cr comprises from about 15 to about 45 weight percent of said inner layer alloy, Al comprises from about 5 to about 30 weight percent of said inner layer alloy, and M' comprises from about 0.01 to about 1.0 weight percent of said inner layer alloy, said inner layer alloy thermally sprayed from a powder having a mean particle size of 50 percentile point in distribution of from about 5 microns to about 50 microns; and (ii) a thermal, e.g., plasma, sprayed outer layer comprising an outer layer alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said outer layer alloy, Cr comprises from about 15 to about 45 weight percent of said outer layer alloy, Al comprises from about 5 to about 30 weight percent of said outer layer alloy, and M' comprises from about 0.01 to about 1.0 weight percent of said outer layer alloy, said outer layer alloy thermally sprayed from a powder having a mean particle size of 50 percentile point in distribution of from about 30 microns to about 100 microns, and said outer layer having a surface roughness of at least 200 micro-inches; and wherein said bondcoat has a thermal expansion of about 6.5 millimeters per meter or less between a temperature of from about 25° C. to about 525° C., and (b) a thermal, e.g., plasma, sprayed ceramic layer applied to said bondcoat layer; wherein said coating has a helium leak rate of less than $6\times10^{-6}$ standard cubic centimeters per second. The inner layer alloy and the outer layer alloy may be of the same or different composition.

The thermal sprayed coatings described above are embodiments of U.S. patent application Ser. No. (21695-R2), filed on an even date herewith and incorporated by reference herein.

Preferred inner layer bondcoats include those wherein, in the composition of the inner layer alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. The alloy is preferably sprayed from a powder having a mean particle size of 50 percentile point in distribution of from about 10 microns to about 40 microns, more preferably a mean particle size of 50 percentile point in distribution of from about 18 microns to about 25 microns.

Preferred outer layer bondcoats include those wherein, in the composition of the outer layer alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. The alloy is preferably sprayed from a powder having a mean particle size of 50 percentile point in distribution of from about 40 microns to about 85 microns, more preferably a mean particle size of 50 percentile point in distribution of from about 50 microns to about 60 microns.

The outer layer bondcoats preferably have a surface roughness of at least 225 micro-inches, more preferably a surface roughness of at least 250 micro-inches. The bondcoats preferably have a thermal expansion of about 6.25 millimeters per meter or less between a temperature of from about 25° C. to about 525° C., more preferably a thermal expansion of about 6.0 millimeters per meter or less between a temperature of from about 25° C. to about 525° C.

The inner layer bondcoats typically have a thickness of from about 4 to about 320 mils, preferably a thickness of from about 40 to about 240 mils, and more preferably a thickness of from about 80 to about 160 mils. The outer layer bondcoats typically have a thickness of from about 4 to about 480 mils, preferably a thickness of from about 80 to about 400 mils, and more preferably a thickness of from about 160 to about 240 mils.

A key measure of a coating's ability to seal is determined by a helium leak rate. A coating which has a helium leak rate of less than $6\times10^{-6}$ atm-cc/sec (standard cubic centimeters per second) is highly desirable, less than $4\times10^{-6}$ atm-cc/sec (standard cubic centimeters per second) is preferred, and less than $2\times10^{-6}$ atm-cc/sec (standard cubic centimeters per second) is more preferred. As set forth herein, the plasma spray methodology and coating composition are important to a successful coating. The plasma spray deposition is preferably sufficient to give a helium leak rate of less than $2.0\times10^{-6}$ standard cubic centimeters per second.

An alpha-Cr phase is present in the bondcoats of this invention up to a temperature of at least about 1000° C. Preferably, the alpha-Cr phase is present in an amount sufficient to control thermal expansion of the bondcoats to about 6.5 mm/m or less between a temperature of from about 25° C. to about 525° C. The bondcoats of this invention may be heat treated to stabilize their equilibrium phases. An alpha-Cr phase is preferably in equilibrium in thermally stabilized bondcoats of this invention at a temperature of about 800° C. and the alpha-Cr phase does not dissolve upon heating to a temperature of at least about 1000° C. The bondcoats of this invention fall within the gamma-beta-alpha-Cr region of a phase diagram, for example, an alpha-Cr+beta-NiAl+gamma (FCC Ni alloy) phase field, at a temperature of about 1150° C.

An oxide dispersion may also be included in the bondcoats of this invention. The oxide dispersion may be selected from alumina, thoria, yttria and rare earth oxides, hafnia and zirconia. The oxide dispersion may comprise from about 5 to about 25 volume percent of the bondcoat composition. This invention also relates to articles produced from the barrier coatings above.

Illustrative ceramic layers comprise zirconium oxide and yttrium oxide. Preferred ceramic layers include zirconia partially or fully stabilized by yttria and having a density greater than 88% of the theoretical density. Other ceramic layers useful in this invention include zirconia partially or fully stabilized by yttria and having a density from about 60% to 85% of the theoretical density, e.g., low density zirconia partially or fully stabilized by yttria. The ceramic layer typically has a thickness of from about 0.001 to about 0.1 inches, preferably from about 0.005 to about 0.05 inches.

Advantageously, the zirconia-based layer is selected from the group consisting of zirconia, partially stabilized zirconia and fully stabilized zirconia. Most advantageously, this layer is a partially stabilized zirconia, such as calcia, ceria or other rare earth oxides, magnesia and yttria-stabilized zirconia. The most preferred stabilizer is yttria. In particular, the partially stabilized zirconia $ZrO_2$-$8Y_2O_3$ provides excellent resistant to heat and corrosion.

The zirconia-based ceramic layer advantageously is thermally insulating and has a density of at least about eighty percent to limit the corrosive effects of hot acidic gases upon the under layer. Most advantageously, this density is at least about ninety percent.

The optional top layer that covers the ceramic is a heat and hot erosion resistant carbide or boride coating. The coating material may be any heat resistant chromium boride or carbide such as, CrB, $Cr_3C_2$, $Cr_7C_3$ or $Cr_{23}C_6$. The coating may be a pure carbide/boride or in a heat resistant alloy matrix of cobalt or nickel-base superalloy.

Some suitable metal substrates include, for example, nickel base superalloys, nickel base superalloys containing titanium, cobalt base superalloys, and cobalt base superalloys containing titanium. Preferably, the nickel base superalloys would contain more than 50% by weight nickel and the cobalt base superalloys would contain more than 50% by weight cobalt. Illustrative non-metal substrates include, for example, permissible silicon-containing materials.

The bondcoat layer can be deposited onto a metal or non-metal substrate, and the ceramic layer can be deposited onto the bondcoat layer, using any thermal spray device by conventional methods. Preferred thermal spray methods for depositing the bondcoat layers and the ceramic layer are plasma spraying including inert gas shrouded plasma spraying and low pressure or vacuum plasma spraying in chambers. Other deposition methods that may be useful in this invention include high velocity oxygen-fuel torch spraying, detonation gun coating and the like. The most preferred method is inert gas shrouded plasma spraying and low pressure or vacuum plasma spraying in chambers. It could also be advantageous to heat treat the bondcoats using appropriate times and temperatures to achieve a good bond for the bondcoats to the substrate and a high sintered density of the bondcoats. Other means of applying a uniform deposit of powder to a substrate in addition to thermal spraying include, for example, electrophoresis, electroplating and slurry deposition.

The method of this invention preferably employs plasma spray methodology. The plasma spraying is suitably carried out using fine agglomerated powder particle sizes, typically having an average agglomerated particle size of less than about 50 microns, preferably less than about 40 microns, and more preferably from about 5 to about 50 microns. Individual particles useful in preparing the agglomerates typically range in size from nanocrystalline size to about 5 microns in size. The plasma medium can be argon, helium or a combination thereof.

The thermal content of the plasma gas stream can be varied by changing the electrical power level, gas flow rates, or gas composition. Argon is usually the base gas, but helium, hydrogen and nitrogen are frequently added. The velocity of the plasma gas stream can also be varied by changing the same parameters.

Variations in gas stream velocity from the plasma spray device can result in variations in particle velocities and hence dwell time of the particle in flight. This affects the time the particle can be heated and accelerated and, hence, its maximum temperature and velocity. Dwell time is also affected by the distance the particle travels between the torch or gun and the surface to be coated.

The specific deposition parameters depend on both the characteristics of the plasma spray device and the materials being deposited. The rate of change or the length of time the parameters are held constant are a function of both the required coating composition, the rate of traverse of the gun or torch relative to the surface being coated, and the size of the part. Thus, a relatively slow rate of change when coating a large part may be the equivalent of a relatively large rate of change when coating a small part.

As indicated above, this invention relates to a method for protecting a metal or non-metal substrate, said method comprising applying a thermally sprayed ceramic coating to said metal or non-metal substrate, wherein said ceramic coating has a helium leak rate of less than $6\times10^{-6}$ standard cubic centimeters per second.

Illustrative ceramic coatings comprise zirconium oxide and yttrium oxide. Preferred ceramic coatings include zirconia partially or fully stabilized by yttria and having a density greater than 88% of the theoretical density. Other ceramic coatings useful in this invention include zirconia partially or fully stabilized by yttria and having a density from about 60% to 85% of the theoretical density, e.g., low density zirconia partially or fully stabilized by yttria. The ceramic coatings typically have a thickness of from about 0.001 to about 0.1 inches, preferably from about 0.005 to about 0.05 inches.

Advantageously, the zirconia-based coating is selected from the group consisting of zirconia, partially stabilized zirconia and fully stabilized zirconia. Most advantageously, this coating is a partially stabilized zirconia, such as calcia, ceria or other rare earth oxides, magnesia and yttria-stabilized zirconia. The most preferred stabilizer is yttria. In particular, the partially stabilized zirconia $ZrO_2$-$8Y_2O_3$ provides excellent resistant to heat and corrosion.

The zirconia-based ceramic coating advantageously is thermally insulating and has a density of at least about eighty percent to limit the corrosive effects of hot acidic gases upon the substrate. Most advantageously, this density is at least about ninety percent.

An optional top layer that can cover the ceramic coating is a heat and hot erosion resistant carbide or boride coating. The coating material may be any heat resistant chromium boride or carbide such as, CrB, $Cr_3C_2$, $Cr_7C_3$ or $Cr_{23}C_6$. The coating may be a pure carbide/boride or in a heat resistant alloy matrix of cobalt or nickel-base superalloy.

A key measure of a coating's ability to seal is determined by a helium leak rate. A coating which has a helium leak rate of less than $6\times10^{-6}$ atm-cc/sec (standard cubic centimeters per second) is highly desirable, less than $4\times10^{-6}$ atm-cc/sec (standard cubic centimeters per second) is preferred, and less than $2\times10^{-6}$ atm-cc/sec (standard cubic centimeters per second) is more preferred. As set forth herein, the plasma spray methodology and coating composition are important to a successful leak tight coating. The plasma spray deposition is preferably sufficient to give a helium leak rate of less than $2.0\times10^{-6}$ standard cubic centimeters per second.

The ceramic coating can be deposited onto a metal or non-metal substrate using any thermal spray device by conventional methods. Preferred thermal spray methods for depositing the ceramic coatings are plasma spraying including inert gas shrouded plasma spraying and low pressure or vacuum plasma spraying in chambers. Other deposition methods that may be useful in this invention include high velocity oxygen-fuel torch spraying, detonation gun coating and the like. The most preferred method is inert gas shrouded plasma spraying and low pressure or vacuum plasma spraying in chambers. It could also be advantageous to heat treat the ceramic coating using appropriate times and temperatures to achieve a good bond for the ceramic coating to the substrate and a high sintered density of the ceramic coating. Other means of applying a uniform deposit of powder to a substrate in addition to thermal spraying include, for example, electrophoresis, electroplating and slurry deposition.

The method of this invention preferably employs plasma spray methodology. The plasma spraying is suitably carried out using fine agglomerated powder particle sizes, typically having an average agglomerated particle size of less than about 50 microns, preferably less than about 40 microns, and more preferably from about 5 to about 50 microns. Individual particles useful in preparing the agglomerates typically range in size from nanocrystalline size to about 5 microns in size. The plasma medium can be argon, helium or a combination thereof.

The thermal content of the plasma gas stream can be varied by changing the electrical power level, gas flow rates, or gas composition. Argon is usually the base gas, but helium, hydrogen and nitrogen are frequently added. The velocity of the plasma gas stream can also be varied by changing the same parameters.

Variations in gas stream velocity from the plasma spray device can result in variations in particle velocities and hence dwell time of the particle in flight. This affects the time the particle can be heated and accelerated and, hence, its maximum temperature and velocity. Dwell time is also affected by the distance the particle travels between the torch or gun and the surface to be coated.

The specific deposition parameters depend on both the characteristics of the plasma spray device and the materials being deposited. The rate of change or the length of time the parameters are held constant are a function of both the required coating composition, the rate of traverse of the gun or torch relative to the surface being coated, and the size of the part. Thus, a relatively slow rate of change when coating a large part may be the equivalent of a relatively large rate of change when coating a small part.

As indicated above, this invention further relates to a method for protecting, e.g., minimizing or eliminating corrosion, a metal or non-metal substrate, said method comprising (i) applying a thermal, e.g., plasma, sprayed bondcoat layer to said metal or non-metal substrate, said bondcoat layer comprising an alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said alloy, Cr comprises from about 15 to about 45 weight percent of said alloy, Al comprises from about 5 to about 30 weight percent of said alloy, and M' comprises from about 0.01 to about 1.0 weight percent of said alloy, said alloy thermally sprayed from a powder having a mean particle size of 50 percentile point in distribution of from about 5 microns to about 100 microns, said bondcoat having a surface roughness of at least 200 micro-inches, and wherein said bondcoat layer has a thermal expansion of about 6.5 millimeters per meter or less between a temperature of from about 25° C. to about 525° C., and (ii) applying a thermal, e.g., plasma, sprayed ceramic layer to said bondcoat layer; wherein said bondcoat layer and said ceramic layer have a helium leak rate of less than $6\times10^{-6}$ standard cubic centimeters per second.

Preferred bondcoat layers of this invention include those wherein, in the composition of the alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. In one embodiment, the alloy is sprayed from a coarse powder having a mean particle size of 50 percentile point in distribution of from about 30 microns to about 100 microns, preferably a mean particle size of 50 percentile point in distribution of from about 40 microns to about 85 microns, and more preferably a mean particle size of 50 percentile point in distribution of from about 50 microns to about 60 microns. In another embodiment, the alloy is sprayed from a fine powder having a mean particle size of 50 percentile point in distribution of from about 5 microns to about 50 microns, preferably a mean particle size of 50 percentile point in distribution of from about 10 microns to about 40 microns, and more preferably a mean particle size of 50 percentile point in distribution of from about 18 microns to about 25 microns.

The bondcoat layers of this invention preferably have a surface roughness of at least 225 micro-inches, more preferably a surface roughness of at least 250 micro-inches. The bondcoat layers preferably have a thermal expansion of about 6.25 millimeters per meter or less between a temperature of from about 25° C. to about 525° C., more preferably a thermal expansion of about 6.0 millimeters per meter or less between a temperature of from about 25° C. to about 525° C. The bondcoat layers typically have a thickness of from about 4 to about 480 mils, preferably a thickness of from about 80 to about 400 mils, and more preferably a thickness of from about 160 to about 240 mils.

A key measure of a coating's ability to seal is determined by a helium leak rate. A coating which has a helium leak rate of less than $6\times10^{-6}$ atm-cc/sec (standard cubic centimeters per second) is highly desirable, less than $4\times10^{-6}$ atm-cc/sec (standard cubic centimeters per second) is preferred, and less than $2\times10^{-6}$ atm-cc/sec (standard cubic centimeters per second) is more preferred. As set forth herein, the plasma spray methodology and coating composition are important to a successful coating. The plasma spray deposition is preferably sufficient to give a helium leak rate of less than $2.0\times10^{-6}$ standard cubic centimeters per second.

An alpha-Cr phase is present in the bondcoat layers of this invention up to a temperature of at least about 1000° C.

Preferably, the alpha-Cr phase is present in an amount sufficient to control thermal expansion of the bondcoat layer to about 6.5 mm/m or less between a temperature of from about 25° C. to about 525° C. The bondcoat layers of this invention may be heat treated to stabilize their equilibrium phases. An alpha-Cr phase is preferably in equilibrium in thermally stabilized bondcoat layer of this invention at a temperature of about 800° C and the alpha-Cr phase does not dissolve upon heating to a temperature of at least about 1000° C. The bondcoat layers of this invention fall within the gamma-beta-alpha-Cr region of a phase diagram, for example, an alpha-Cr+beta-NiAl+gamma (FCC Ni alloy) phase field, at a temperature of about 1150° C.

An oxide dispersion may also be included in the bondcoat layers of this invention. The oxide dispersion may be selected from alumina, thoria, yttria and rare earth oxides, hafnia and zirconia. The oxide dispersion may comprise from about 5 to about 25 volume percent of the bondcoat layer.

Illustrative ceramic layers comprise zirconium oxide and yttrium oxide. Preferred ceramic layers include zirconia partially or fully stabilized by yttria and having a density greater than 88% of the theoretical density. Other ceramic layers useful in this invention include zirconia partially or fully stabilized by yttria and having a density from about 60% to 85% of the theoretical density, e.g., low density zirconia partially or fully stabilized by yttria. The ceramic layer typically has a thickness of from about 0.001 to about 0.1 inches, preferably from about 0.005 to about 0.05 inches.

Advantageously, the zirconia-based layer is selected from the group consisting of zirconia, partially stabilized zirconia and fully stabilized zirconia. Most advantageously, this layer is a partially stabilized zirconia, such as calcia, ceria or other rare earth oxides, magnesia and yttria-stabilized zirconia. The most preferred stabilizer is yttria. In particular, the partially stabilized zirconia $ZrO_2$-$8Y_2O_3$ provides excellent resistant to heat and corrosion.

The zirconia-based ceramic layer advantageously is thermally insulating and has a density of at least about eighty percent to limit the corrosive effects of hot acidic gases upon the under layer. Most advantageously, this density is at least about ninety percent.

The optional top layer that covers the ceramic is a heat and hot erosion resistant carbide or boride coating. The coating material may be any heat resistant chromium boride or carbide such as, CrB, $Cr_3C_2$, $Cr_7C_3$ or $Cr_{23}C_6$. The coating may be a pure carbide/boride or in a heat resistant alloy matrix of cobalt or nickel-base superalloy.

Some suitable metal substrates include, for example, nickel base superalloys, nickel base superalloys containing titanium, cobalt base superalloys, and cobalt base superalloys containing titanium. Preferably, the nickel base superalloys would contain more than 50% by weight nickel and the cobalt base superalloys would contain more than 50% by weight cobalt. Illustrative non-metal substrates include, for example, permissible silicon-containing materials.

The bondcoat layer can be deposited onto a metal or non-metal substrate, and the ceramic layer can be deposited onto the bondcoat layer, using any thermal spray device by conventional methods. Preferred thermal spray methods for depositing the bondcoat layer and ceramic layer are plasma spraying including inert gas shrouded plasma spraying and low pressure or vacuum plasma spraying in chambers. Other deposition methods that may be useful in this invention include high velocity oxygen-fuel torch spraying, detonation gun coating and the like. The most preferred method is inert gas shrouded plasma spraying and low pressure or vacuum plasma spraying in chambers. It could also be advantageous to heat treat the bondcoat using appropriate times and temperatures to achieve a good bond for the bondcoat to the substrate and a high sintered density of the bondcoat. Other means of applying a uniform deposit of powder to a substrate in addition to thermal spraying include, for example, electrophoresis, electroplating and slurry deposition.

The method of this invention preferably employs plasma spray methodology. The plasma spraying is suitably carried out using fine agglomerated powder particle sizes, typically having an average agglomerated particle size of less than about 50 microns, preferably less than about 40 microns, and more preferably from about 5 to about 50 microns. Individual particles useful in preparing the agglomerates typically range in size from nanocrystalline size to about 5 microns in size. The plasma medium can be argon, helium or a combination thereof.

The thermal content of the plasma gas stream can be varied by changing the electrical power level, gas flow rates, or gas composition. Argon is usually the base gas, but helium, hydrogen and nitrogen are frequently added. The velocity of the plasma gas stream can also be varied by changing the same parameters.

Variations in gas stream velocity from the plasma spray device can result in variations in particle velocities and hence dwell time of the particle in flight. This affects the time the particle can be heated and accelerated and, hence, its maximum temperature and velocity. Dwell time is also affected by the distance the particle travels between the torch or gun and the surface to be coated.

The specific deposition parameters depend on both the characteristics of the plasma spray device and the materials being deposited. The rate of change or the length of time the parameters are held constant are a function of both the required coating composition, the rate of traverse of the gun or torch relative to the surface being coated, and the size of the part. Thus, a relatively slow rate of change when coating a large part may be the equivalent of a relatively large rate of change when coating a small part.

In an embodiment, the bondcoat may comprise two metallic layers, both of the same or different low expansion alloy composition. An inner layer bondcoat may be made using fine powder for the thermal spray that is dense and protective to the substrate from oxidation. An outer layer bondcoat may be made from coarser powder to provide a rougher surface for the subsequent attachment of the ceramic layer.

As indicated herein, this invention further relates to a method for protecting, e.g., minimizing or eliminating corrosion, a metal or non-metal substrate, said method comprising (a) applying a thermal, e.g., plasma, sprayed bondcoat layer to said metal or non-metal substrate, said bondcoat layer comprising: (i) a thermal, e.g., plasma, sprayed inner layer comprising an inner layer alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said inner layer alloy, Cr comprises from about 15 to about 45 weight percent of said inner layer alloy, Al comprises from about 5 to about 30 weight percent of said inner layer alloy, and M' comprises from about 0.01 to about 1.0 weight percent of said inner layer alloy, said inner layer alloy thermally sprayed from a powder having a mean particle size of 50 percentile point in distribution of from about 5 microns to about 50 microns; and (ii) a thermal, e.g., plasma, sprayed outer layer comprising an outer layer alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said outer layer alloy, Cr comprises from about 15 to about 45 weight percent of said outer layer alloy, Al comprises from about 5 to about 30 weight percent of said outer layer alloy, and M' comprises from about 0.01 to about 1.0 weight percent of said outer layer alloy, said outer layer alloy thermally sprayed from a powder having a mean particle size of 50 percentile point in distribution of from about 30 microns to about 100 microns, and said outer layer having a surface roughness of at least 200 micro-inches; and wherein said bondcoat has a thermal expansion of about 6.5 millimeters per meter or less between a temperature of from about 25° C. to about 525° C. and (b) applying a thermal, e.g., plasma, sprayed ceramic layer to said bondcoat layer; wherein said bondcoat layer and said ceramic layer have a helium leak rate of less than $6\times10^{-6}$ standard cubic centimeters per second. The inner layer alloy and the outer layer alloy may be of the same or different composition.

The method described above is an embodiment of U.S. patent application Ser. No. (21695-R2) filed on an even date herewith and incorporated by reference herein.

Preferred inner layer bondcoats include those wherein, in the composition of the inner layer alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. The alloy is preferably sprayed from a powder having a mean particle size of 50 percentile point in distribution of from about 10 microns to about 40 microns, more preferably a mean particle size of 50 percentile point in distribution of from about 18 microns to about 25 microns.

Preferred outer layer bondcoats include those wherein, in the composition of the outer layer alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. The alloy is preferably sprayed from a powder having a mean particle size of 50 percentile point in distribution of from about 40 microns to about 85 microns, more preferably a mean particle size of 50 percentile point in distribution of from about 50 microns to about 60 microns.

The outer layer bondcoats preferably have a surface roughness of at least 225 micro-inches, more preferably a surface roughness of at least 250 micro-inches. The bondcoats preferably have a thermal expansion of about 6.25 millimeters per meter or less between a temperature of from about 25° C. to about 525° C., more preferably a thermal expansion of about 6.0 millimeters per meter or less between a temperature of from about 25° C. to about 525° C.

The inner layer bondcoats typically have a thickness of from about 4 to about 320 mils, preferably a thickness of from about 40 to about 240 mils, and more preferably a thickness of from about 80 to about 160 mils. The outer layer bondcoats typically have a thickness of from about 4 to about 480 mils, preferably a thickness of from about 80 to about 400 mils, and more preferably a thickness of from about 160 to about 240 mils.

A key measure of a coating's ability to seal is determined by a helium leak rate. A coating which has a helium leak rate of less than $6\times10^{-6}$ atm-cc/sec (standard cubic centimeters per second) is highly desirable, less than $4\times10^{-6}$ atm-cc/sec (standard cubic centimeters per second) is preferred, and less than $2\times10^{-6}$ atm-cc/sec (standard cubic centimeters per second) is more preferred. As set forth herein, the plasma spray methodology and coating composition are important to a successful coating. The plasma spray deposition is preferably sufficient to give a helium leak rate of less than $2.0\times10^{-6}$ standard cubic centimeters per second.

An alpha-Cr phase is present in the bondcoats of this invention up to a temperature of at least about 1000° C. Preferably, the alpha-Cr phase is present in an amount sufficient to control thermal expansion of the bondcoats to about 6.5 mm/m or less between a temperature of from about 25° C. to about 525° C. The bondcoats of this invention may be heat treated to stabilize their equilibrium phases. An alpha-Cr phase is preferably in equilibrium in thermally stabilized bondcoats of this invention at a temperature of about 800° C. and the alpha-Cr phase does not dissolve upon heating to a temperature of at least about 1000° C. The bondcoats of this invention fall within the gamma-beta-alpha-Cr region of a phase diagram, for example, an alpha-Cr+beta-NiAl+gamma (FCC Ni alloy) phase field, at a temperature of about 1150° C.

An oxide dispersion may also be included in the bondcoats of this invention. The oxide dispersion may be selected from alumina, thoria, yttria and rare earth oxides, hafnia and zirconia. The oxide dispersion may comprise from about 5 to about 25 volume percent of the bondcoat composition.

Illustrative ceramic layers comprise zirconium oxide and yttrium oxide. Preferred ceramic layers include zirconia partially or fully stabilized by yttria and having a density greater than 88% of the theoretical density. Other ceramic layers useful in this invention include zirconia partially or fully stabilized by yttria and having a density from about 60% to 85% of the theoretical density, e.g., low density zirconia partially or fully stabilized by yttria. The ceramic layer typically has a thickness of from about 0.001 to about 0.1 inches, preferably from about 0.005 to about 0.05 inches.

Advantageously, the zirconia-based layer is selected from the group consisting of zirconia, partially stabilized zirconia and fully stabilized zirconia. Most advantageously, this layer is a partially stabilized zirconia, such as calcia, ceria or other rare earth oxides, magnesia and yttria-stabilized zirconia. The most preferred stabilizer is yttria. In particular, the partially stabilized zirconia $ZrO_2$-$8Y_2O_3$ provides excellent resistant to heat and corrosion.

The zirconia-based ceramic layer advantageously is thermally insulating and has a density of at least about eighty percent to limit the corrosive effects of hot acidic gases upon the under layer. Most advantageously, this density is at least about ninety percent.

The optional top layer that covers the ceramic is a heat and hot erosion resistant carbide or boride coating. The coating material may be any heat resistant chromium boride or carbide such as, CrB, $Cr_3C_2$, $Cr_7C_3$ or $Cr_{23}C_6$. The coating may be a pure carbide/boride or in a heat resistant alloy matrix of cobalt or nickel-base superalloy.

Some suitable metal substrates include, for example, nickel base superalloys, nickel base superalloys containing titanium, cobalt base superalloys, and cobalt base superalloys containing titanium. Preferably, the nickel base superalloys would contain more than 50% by weight nickel and the cobalt base superalloys would contain more than 50% by weight cobalt. Illustrative non-metal substrates include, for example, permissible silicon-containing materials.

The bondcoat layer can be deposited onto a metal or non-metal substrate, and the ceramic layer can be deposited onto the bondcoat layer, using any thermal spray device by conventional methods. Preferred thermal spray methods for depositing the bondcoat layers and ceramic layer are plasma spraying including inert gas shrouded plasma spraying and low pressure or vacuum plasma spraying in chambers. Other deposition methods that may be useful in this invention include high velocity oxygen-fuel torch spraying, detonation gun coating and the like. The most preferred method is inert gas shrouded plasma spraying and low pressure or vacuum plasma spraying in chambers. It could also be advantageous to heat treat the bondcoats using appropriate times and temperatures to achieve a good bond for the bondcoats to the substrate and a high sintered density of the bondcoats. Other means of applying a uniform deposit of powder to a substrate in addition to thermal spraying include, for example, electrophoresis, electroplating and slurry deposition.

The method of this invention preferably employs plasma spray methodology. The plasma spraying is suitably carried out using fine agglomerated powder particle sizes, typically having an average agglomerated particle size of less than about 50 microns, preferably less than about 40 microns, and more preferably from about 5 to about 50 microns. Individual particles useful in preparing the agglomerates typically range in size from nanocrystalline size to about 5 microns in size. The plasma medium can be argon, helium or a combination thereof.

The thermal content of the plasma gas stream can be varied by changing the electrical power level, gas flow rates, or gas composition. Argon is usually the base gas, but helium, hydrogen and nitrogen are frequently added. The velocity of the plasma gas stream can also be varied by changing the same parameters.

Variations in gas stream velocity from the plasma spray device can result in variations in particle velocities and hence dwell time of the particle in flight. This affects the time the particle can be heated and accelerated and, hence, its maximum temperature and velocity. Dwell time is also affected by the distance the particle travels between the torch or gun and the surface to be coated.

The specific deposition parameters depend on both the characteristics of the plasma spray device and the materials being deposited. The rate of change or the length of time the parameters are held constant are a function of both the required coating composition, the rate of traverse of the gun or torch relative to the surface being coated, and the size of the part. Thus, a relatively slow rate of change when coating a large part may be the equivalent of a relatively large rate of change when coating a small part.

The coatings of this invention can be graded with respect to chemical composition, density, porosity through the thickness or along other dimensions of the component. Various functional components can be incorporated into the coatings including, for example, coloring agents, emissivity control agents, degradation monitor agents, reflectivity agents, and the like. Additionally, the top layer of the coatings of this invention can be such that it interacts with the constituents in the reactor or the fluid stream to form a passivating layer.

The coatings of this invention may be useful for chemical processing equipment used at low and high temperatures, e.g., in harsh thermal and corrosive environments. The commonly used materials of construction for tanks, pipes and other processing equipment are metals and alloys. These metals and alloys are selected depending on the particular service requirements. In harsh environments, the equipment can react with the material being processed therein. Ceramic materials that are inert towards the chemicals can be used as coatings on the metallic equipment components. The ceramic coatings should be gas tight, or impervious to fluids, to prevent the corrosive materials from reaching the metallic equipment. Some examples of corrosive liquids include acids, alkali materials, and molten salts such as carbonates. Examples of metallic equipment components include containers for materials like hydrofluoric acid. A coating which can be inert to such corrosive materials and prevent the corrosive materials from reaching the underlying metal will enable the use of less expensive metals and extend the life of the equipment components.

The gas tight coatings can also prevent the interaction of hot liquids with the metallic equipment components. Such hot liquids can be hot acids, alkali materials or even molten metals useful in operations such as galvanizing, casting, and the like. Another possible chemical reaction during processing is the dissolution of gaseous species such as hydrogen or carbon from the gas into the metallic substrate. If the coating does not permit the gas to contact the metal, these undesired reactions can be avoided. Carbon and hydrogen are known to embrittle the metals and alloys that they dissolve in. Other gaseous species such as steam and chlorine can cause stress corrosion cracking of the metallic substrate. Other gases such as hot sulfur compounds react with the metals and form non-passivating corrosion products leading to metal loss and failure of the equipment component.

Illustrative applications of the coatings of this invention include, for example, heat exchangers (particularly shell and tube style). The coating can be applied to the interior, exterior or both the interior and exterior, of the heat exchangers. Illustrative specific applications include coating the exterior of tubes with a thermally conductive, but gas tight layer, to prevent chloride induced stress corrosion cracking, which is typical in exchangers in cooling water service and a corrosive aqueous fluid (e.g., a synthesis gas containing $CO_2$ that upon condensation of the water vapor creates some carbonic acid which is very common in steam methane reformers, ethylene plants and others). A typical solution is to use a more expensive duplex steel to prevent the problem.

Another illustrative application is coating the interior of tubes at the inlet portion to provide a thermal barrier that helps avoid film boiling on the other side, which would lead to overheating and failure of a portion of the heat exchanger tube. A typical application is hot gas from a reactor transferred into a heat recovery boiler. The boiler may utilize ceramic ferrule inserts to prevent the overheating but these can crack and fall out.

Another illustrative application involves coating the interior of vessels containing a high enough partial pressure of hydrogen so that hydrogen embrittlement is avoided. Typically, higher alloys are used in construction of vessels to prevent hydrogen embrittlement.

Another illustrative application involves coating the interior surface of a reactor tube (just outside the heated zone) with a gas tight coating to prevent metal dusting. The use of an oxygen transport membrane style coating can also allow the metal surface below to be passivated.

Various wetted surfaces (e.g., heat exchangers, piping, valves, vessels, inlet distributors, thermocouple wells, burner tips, injector lances) can be coated with a gas tight coating to enhance properties of the device (e.g., oxygen compatible, acid resistant or resistant to bonding of components from the process stream that are difficult to remove.

Various modifications and variations of this invention will be obvious to a worker skilled in the art and it is to be understood that such modifications and variations are to be included within the purview of this application and the spirit and scope of the claims.

The following examples are provided to further describe certain embodiments of the invention. The examples are intended to be illustrative in nature and are not to be construed as limiting the scope of the invention. The examples below describe more particularly the plasma medium, i.e., an inert gas, the plasma torch or plasma gun or arc and power used, the powder used with the plasma medium, and the plasma torch manipulation employed. For the following examples, the powder particles are admixed with the plasma medium. The plasma medium-added particle spray powder mixture or plasma spray feed powder is preferably agglomerated prior to thermal spraying by conventional agglomeration techniques to provide a free-flowing plasma spray feed powder. The plasma medium-added spray metal and/or metal oxide particle mixture is thus preferably agglomerated in order to facilitate entrainment in a plasma plume generated by a plasma torch or spray gun. As another alternative, plasma arc spraying can be used in the method of this invention. Preferably, the plasma spray feed powder has a uniform agglomerated particle size distribution with an average particle size in the range of from about 5 to about 50 microns, preferably from about 5 to about 25 microns.

EXAMPLE 1

A CoCrAlY bondcoat designated as CO-127 by Praxair Surface Technologies, Inc. ("Praxair") is deposited on a stainless steel substrate using a Mach II mode plasma spraying hardware from Praxair. The CoCrAlY powder is fed into the plasma spray gun vertically via argon carrier gas through a powder feeder from Praxair. A Mach II mode of plasma spraying is set up as follows:

Plasma Medium—argon (125 psi) and helium (200 psi);

Plasma Torch and Power—Mach II mode of Praxair SG-100 plasma torch with a power of 800 amps;

Powder and Feed—20 micron agglomerate CoCrAlY powder from Praxair; feed at about 10 mm upstream from the torch exit with argon carrier gas (125 psi) and with Praxair powder feeder;

Torch Manipulation—10 passes at a scan of 1400 inches per minute in a 2.5 mm offset and a distance of 2.5 inches from the substrate.

The CoCrAlY bondcoat formed is about 180 microns in thickness. The helium leak rate of the coating is $2.0\times10^{-6}$ atm-cc/sec (standard cubic centimeters per second).

A $ZrO_2$ second layer is deposited on the CoCrAlY bondcoat using a Mach II mode plasma spraying hardware from Praxair. The $ZrO_2$ powder is fed into the plasma spray gun vertically via argon carrier gas through a powder feeder from Praxair. A Mach II mode of plasma spraying is set up as follows:

Plasma Medium—argon (100 psi) and helium (200 psi);

Plasma Torch and Power—Mach II mode of Praxair SG-100 plasma torch with a power of 800 amps;

Powder and Feed—20 micron agglomerate $ZrO_2$ powder from Praxair; feed at about 10 mm upstream from the torch exit with argon carrier gas (100 psi) and with Praxair powder feeder;

Torch Manipulation—20 passes at a scan of 1400 inches per minute in a 2.5 mm offset and a distance of 2.5 inches from the substrate.

The $ZrO_2$ layer is about 100 microns in thickness. The helium leak rate of the coating is $2.0\times10^{-6}$ atm-cc/sec (standard cubic centimeters per second).

Thermal expansion of a coating is run in a thermally stabilized state in the thermal expansion cycle in a sapphire dilatometer of Praxair Surface Technologies, Inc. The dilatometer is a vertical push-rod instrument, with three support rods and the length-sensing central rod all cut from the same 600 millimeter long single crystal of sapphire. The sample is loaded, the furnace tube is evacuated by a roughing pump then argon is back-filled, three times. Then the argon flow is set to 800 cubic millimeters per second ($mm^3/s$) for the test cycle. The sample has a fine-gauge type K thermocouple wired in tight contact to its mid-length. This provides the specimen temperature to the data logger. The furnace control thermocouple is a separate, heavy gauge type K thermocouple. The heating cycle is separately programmed by a dedicated controller. The specimen length change is monitored by a lightly contacting sapphire rod connected to a linear variable differential transformer, which is remote from the hot zone. Typically, the samples are heated at 5° C. per minute to 1100° C. and immediately cooled to room temperature at 5° C. per minute. If any residual sintering occurred, the data is not included in this study, but the sample is re-run until it is stable.

The dilatometer is calibrated by running a 25 millimeter long sample of pure Ni, traceable to the National Institute of Standards and Technology. The sample is run multiple times and the average heating and cooling curves are compared to the accepted Ni expansion data published by Thermophysical Property Research Center. See Touloukian, et al., Thermal Expansion, Metallic Elements and Alloys, Thermophysical Properties Research Center—Data Series, 12, Plenum, N.Y. 1976. Any deviation is formed into a correction list which the computer applied to all subsequent samples. All samples are run at least twice, most three to four times. The corrected data for each coating is compared to the average of all runs of that coating at each 100° C. increment of the computer printout. A three-sigma rule for outlier data is tested.

Measurement of thermal expansion of a coating is more particularly described in copending U.S. patent application Ser. No. 60/772,524, filed Feb. 13, 2006, the disclosure of which is incorporated herein by reference.

Powder particle size distribution is measured by the light scattering method with the powder sample suspended in a liquid solution (ASTM B 822-97) using a Microtrac model X-100 instrument (Leeds & Northrup, St. Petersburg, Fla.) operated in the X-100 mode.

Coating surface roughness is measured by the contact stylus method (ASTM D 7127-05) using a Taylor Hobson model Surtronic 3P (Leicester, England) in the Ra mode.

The helium leak test is measured using a commercially available helium leak detector such as Varian Model 979 that comprises a vacuum pump, a calibrated pressure sensing electronic device and a port for placing the sample. The unit mentioned above is capable of pulling a vacuum of $1\times10^{-3}$ and detecting a leak of $2\times10^{-10}$ atm cc/sec. The leak measurement process starts with placing a porous metal disk coated with the desired coating on the port of the leak detector unit. A rubber 'O' ring is placed on the coated side. The disk is placed such that the coated side faces the port and the porous substrate is exposed to the atmosphere. The vacuum pump is turned on and the 'Test" procedure on the electronic controls is activated. The instrument attempts to suck air through the coating (assuming that the rubber 'O' ring is sealing the disk to the port). Any air leaking through the coating will prevent the vacuum pump from reaching its rated vacuum level and the electronics are internally calibrated to convert the change in the pressure to a leak rate in ml/sec. The leak rate can be measured using just air and the change in pressure. More accurate measurements can be obtained by squirting helium gas on the porous disk and analyzing the gas pulled through for helium content using a mass spectrometer.

A determination of desired coating conditions is performed using the "Design Of Experiments" method. In essence this method enables the simultaneous evaluation of the effect of several parameters with very few experiments. In this case, the effect of six variables at three different levels are tested. In each case, the experimental parameters are set up, the coating is produced and is evaluated by leak testing. The coating is considered acceptable if the leak rate is less than $6\times10^{-6}$. The experiments for zirconia with 10 mole percent yttria indicate the following:

| Parameter | Primary Argon (psi) | | |
|---|---|---|---|
| Value | 100 | 150 | 200 |
| Average Leak Rate | 4.00 | 2.61 | 3.81 |
| Parameter | Secondary Helium (psi) | | |
| Value | 175 | 225 | 300 |
| Average Leak Rate | 4.46 | 2.45 | 3.51 |
| Parameter | Amps | | |
| Value | 800 | 900 | 1000 |
| Average Leak Rate | 2.58 | 5.69 | 2.16 |
| Parameter | Argon Carrier (psi) | | |
| Value | 30 | 65 | 100 |
| Average Leak Rate | 4.84 | 3.50 | 2.09 |
| Parameter | Standoff (inches) | | |
| Value | 2.25 | 3.00 | 3.75 |
| Average Leak Rate | 3.83 | 2.33 | 4.74 |
| Parameter | Surface Velocity (inches/minute) | | |
| Value | 1000 | 1550 | 2100 |
| Average Leak Rate | 5.25 | 2.23 | 2.95 |

The experiments indicate that for zirconia with 10 mole percent yttria, the desirable ranges of the parameters (listed in order of their importance to the coating process) are as follows:

| | | |
|---|---|---|
| (1) Argon carrier pressure | 65 to 100 | psi |
| (2) Stand off (distance of the spray device from the work piece) | 2.25 to 3.0 | inches |
| (3) Surface velocity (workpiece relative to plasma flame) | 1500 to 2000 | inches/minute |
| (4) Current | 1000 | amps |
| (5) Primary gas pressure | 150 to 200 | psi |
| (6) Secondary gas pressure | 225 to 300 | psi |

EXAMPLE 2

The outer conical tip of a 2 inch diameter atomizer as well as the first foot of the 2 inch diameter pipe are coated to improve the resistance to nickel sulfidation and dissolution by the gas phase sulfuric acid that occurs at the high furnace temperature (nominal 1800-2000° F). This atomizer tip is used in a spent sulfuric acid regeneration application for 6 months with minimal wear. An uncoated tip in the same spent sulfuric acid regeneration application needs to be replaced every 4-8 weeks. Less expensive alloys (e.g., alloys other than Haynes HR160 and Hastelloy C276) may be used in making the atomizer if the coating continues to perform. The more expensive alloys (e.g., alloys other than Haynes HR160 and Hastelloy C276) cost about $40-$90 per pound depending on the form versus stainless steel that costs less than $10 per pound. The tips of the oxygen injection lances may be coated for the same purpose.

While it has been shown and described what is considered to be certain embodiments of the invention, it will, of course, be understood that various modifications and changes in form or detail can readily be made without departing from the spirit and scope of the invention. It is, therefore, intended that this invention not be limited to the exact form and detail herein shown and described, nor to anything less than the whole of the invention herein disclosed and hereinafter claimed.

The invention claimed is:

1. A coating for a metal or non-metal substrate comprising:

(i) a thermal sprayed bondcoat layer applied to said substrate comprising an alloy of MCrAlM' wherein M is an element selected from nickel, cobalt, iron and mixtures thereof, and M' is an element selected from yttrium, zirconium, hafnium, ytterbium and mixtures thereof, and wherein M comprises from about 35 to about 80 weight percent of said alloy, Cr comprises from about 15 to about 45 weight percent of said alloy, Al comprises from about 5 to about 30 weight percent of said alloy, and M' comprises from about 0.01 to about 1.0 weight percent of said alloy, said alloy thermally sprayed from a powder having a mean particle size of 50 percentile point in distribution of from about 5 microns to about 100 microns, said bondcoat having a surface roughness of at least 200 micro-inches, said bondcoat having a thermal expansion of about 6.5 millimeters per meter or less between a temperature of from about 25° C. to about 525° C., and said bondcoat having a thickness of from about 4 to about 480 mils, and (ii) a thermal sprayed ceramic layer applied to said bondcoat layer, said ceramic layer having a thickness of from about 0.001 to about 0.1 inches;

wherein said coating has a helium leak rate of less than $6\times10^{-6}$ standard cubic centimeters per second.

2. The coating of claim 1 wherein M is nickel and M' is yttrium.

3. The coating of claim 1 wherein said alloy is thermally sprayed from a powder having a mean particle size of 50 percentile point in distribution of from about 30 microns to about 100 microns.

4. The coating of claim 1 wherein said bondcoat has a surface roughness of at least 225 micro-inches.

5. The coating of claim 1 wherein:

M comprises from about 40 to about 70 weight percent of said alloy,

Cr comprises from about 20 to about 40 weight percent of said alloy,

Al comprises from about 10 to about 25 weight percent of said alloy, and

M' comprises from about 0.05 to about 0.95 weight percent of said alloy.

6. The coating of claim 1 wherein an alpha-Cr phase is present in said bondcoat layer up to a temperature of at least about 1000° C.

7. The coating of claim 1 that is heat treated to stabilize equilibrium phases of said coating.

8. The coating of claim 1 wherein an alpha-Cr phase is in equilibrium in said bondcoat layer that has been thermally stabilized at a temperature of about 800° C. and said alpha-Cr phase does not dissolve upon heating to a temperature of at least about 1000° C.

9. The coating of claim 1 wherein the bondcoat falls within an alpha-Cr+beta-NiAl+gamma (FCC Ni alloy) phase field at a temperature of about 1150° C.

10. The coating of claim 1 wherein said ceramic layer comprises a zirconia-based coating selected from zirconia, partially stabilized zirconia and fully stabilized zirconia.

11. The coating of claim 1 where the ceramic layer comprises zirconium oxide and yttrium oxide.

12. The coating of claim 1 wherein said ceramic layer comprises a zirconia-based coating having a density from about 60% to about 85% of the theoretical density.

13. The coating of claim 1 wherein said ceramic layer is thermally sprayed from a powder having an average agglomerated particle size of less than about 50 microns.

14. The coating of claim 1 which comprises a plasma sprayed bondcoat layer and a plasma sprayed ceramic layer.

15. The coating of claim 14 wherein the plasma spraying is selected from inert gas shrouded plasma spraying and low pressure or vacuum plasma spraying in chambers.

16. A metal or non-metal substrate coated with the coating of claim 1.

17. A metal or non-metal substrate coated with a coating by a method, said method comprising:

(i) applying a thermal sprayed bondcoat layer to a metal or non-metal substrate, said bondcoat layer comprising an alloy of MCrAlM' wherein M is an element selected from nickel, cobalt, iron and mixtures thereof, and M' is an element selected from yttrium, zirconium, hafnium, ytterbium and mixtures thereof, and wherein M comprises from about 35 to about 80 weight percent of said alloy, Cr comprises from about 15 to about 45 weight percent of said alloy, Al comprises from about 5 to about 30 weight percent of said alloy, and M' comprises from about 0.01 to about 1.0 weight percent of said alloy, said alloy thermally sprayed from a powder having a mean s article size of 50 percentile point in distribution of from about 5 microns to about 100 microns, said bondcoat having a surface roughness of at least 200 micro-inches, wherein said bondcoat layer has a thermal expansion of about 6.5 millimeters per meter or less between a temperature of from about 25° C. to about 525° C., and said bondcoat having a thickness of from about 4 to about 480 mils; and ii) applying a thermal sprayed ceramic layer to said bondcoat layer, said ceramic layer having a thickness of from about 0.001 to about 0.1 inches;

wherein said bondcoat layer and said ceramic layer have a helium leak rate of less than $6\times10^{-6}$ standard cubic centimeters per second.

* * * * *